US006378653B1

(12) United States Patent
Takahashi

(10) Patent No.: US 6,378,653 B1
(45) Date of Patent: Apr. 30, 2002

(54) TRAVEL AND ROTATION CONTROL DEVICE FOR BOOM LIFT

(75) Inventor: Norihisa Takahashi, Saitama (JP)

(73) Assignee: Kabushiki Kaisha Aichi Corporation, Aichi (JP)

( * ) Notice: Subject to any disclaimer, the term of this patent is extended or adjusted under 35 U.S.C. 154(b) by 0 days.

(21) Appl. No.: 09/468,394

(22) Filed: Dec. 20, 1999

(30) Foreign Application Priority Data

Dec. 28, 1998 (JP) ..... 10-373133
Feb. 25, 1999 (JP) ..... 11-048966

(51) Int. Cl.[7] ..... E06C 1/00
(52) U.S. Cl. ..... 182/69.4; 182/62.5; 182/63
(58) Field of Search ..... 182/62.5, 63, 66.1, 182/66.2, 69.4, 128; 212/149; 414/10, 744.5

(56) References Cited

U.S. PATENT DOCUMENTS 3,868,022 A * 2/1975 Greenlay et al. ..... 212/8 R
3,977,530 A * 8/1976 Helm et al. ..... 212/46 R
4,064,997 A * 12/1977 Holland et al. ..... 212/39 B
4,516,117 A * 5/1985 Couture et al. ..... 340/685
4,989,567 A * 2/1991 Fujioka ..... 123/385
5,018,923 A * 5/1991 Melan et al. ..... 414/10
5,045,034 A * 9/1991 Almeda, Jr. ..... 475/5
5,048,296 A * 9/1991 Sunamura et al. ..... 60/468
5,119,949 A * 6/1992 Kishi ..... 212/154
5,307,898 A * 5/1994 Purdy et al. ..... 182/63
5,343,739 A * 9/1994 Curry ..... 212/151
5,352,965 A * 10/1994 Kawabata ..... 318/807
5,732,835 A * 3/1998 Morita et al. ..... 212/278
5,826,666 A * 10/1998 Tozawa et al. ..... 172/7

FOREIGN PATENT DOCUMENTS

JP H6-47906 12/1994

* cited by examiner

*Primary Examiner*—Bruce A. Lev
(74) *Attorney, Agent, or Firm*—Klauber & Jackson

(57) ABSTRACT

In a boom lift vehicle comprising a vehicle equipped with a travel apparatus and capable of travel, a boom that is attached to said vehicle and is at least vertically tiltable and horizontally rotatable, and a work platform attached to the distal end of said boom; a travel and rotation control device for controlling the travel of said vehicle and/or the rotation of said boom. The control device includes a travel command means for outputting commands for the travel of the vehicle; boom rotation command means for outputting commands for rotationally operating the boom; position detection means for detecting the position of the work platform with respect to said vehicle; and control means for calculating the movement speed of the work platform at a position detected by the position detection means according to a travel command issued by the travel command means and/or a boom rotation command issued by the boom rotation command means, and controlling the travel of the vehicle and/or the rotation of the boom so that the movement speed of the work apparatus does not exceed a predetermined base speed.

11 Claims, 7 Drawing Sheets

TRAVEL AND ROTATION CONTROL DEVICE FOR BOOM LIFT

FIELD OF THE INVENTION

The present invention relates to a boom lift in which a boom that can be raised, lowered, rotated, etc., is attached to a vehicle that is equipped with a travel apparatus and is capable of travel, and a work apparatus is provided to the distal end of this boom. More particularly, it relates to a device for controlling the travel and rotation of this boom lift.

BACKGROUND OF THE INVENTION

Lifts generally comprise a boom that is hoistably and rotatably attached to a chassis, and a work platform on which a worker stands and which is oscillatably (able to rotate horizontally) attached to the distal end of the boom, and are designed such that the boom is raised, lowered, or rotated so as to move the work platform to the desired position by operating a boom control device provided to the work platform. With a lift such as this, the lifting work is usually performed after jacks provided to the chassis have been deployed downward so as to stabilize the chassis on the ground, but sometimes the work is performed while the chassis travels with the worker standing on the work platform.

When the chassis is thus made to travel while a worker is standing on the work platform, the worker on the work platform will be subjected to an impact (or shock) due to momentum, etc., if the platform is accelerated, decelerated, or stopped during its travel. This impact is exacerbated when the chassis is traveling with the boom deployed (raised, lowered, extended, or rotated). This impact tends to be particularly large when the flexural rigidity of the boom in the lateral direction is less than that in the longitudinal direction, and the boom is extended to the side or upward.

There are also times when the boom is rotationally operated while the chassis is traveling, in which case the work platform may move at an excessive speed, and there is the danger that a worker on the platform will be subjected to a large impact if the chassis should come to a sudden stop. Furthermore, travel in this state poses the danger that a large lateral momentum will be applied to the vehicle and travel stability will be lost.

SUMMARY OF THE INVENTION

It is an object of the present invention to provide a control device for a boom lift, designed such that a worker on the work platform will not be subjected to a large impact (momentum) if the chassis should accelerate or halt during its travel, regardless of the amount or position of boom deployment.

It is a further object of the present invention to provide a control device for a boom lift with which travel stability can be ensured for a vehicle so that a worker on the work apparatus (work platform) will not be subjected to a large impact (momentum) even if the boom is rotated while the vehicle is rotationally traveling.

The present invention is therefore a travel and rotation control device for a boom lift comprising a vehicle equipped with a travel apparatus and capable of travel, a boom that is attached to the vehicle and is at least hoistable and rotatable, and a work apparatus attached to the distal end of the boom, this control device comprising travel command means for outputting commands for the travel of the vehicle, boom rotation command means for outputting commands for rotationally operating the boom, position detection means for detecting the position of the work apparatus with respect to the vehicle, and control means for calculating the movement speed of the work apparatus at a position detected by the position detection means according to a travel command issued by the travel command means and/or a boom rotation command issued by the boom rotation command means, and controlling the travel of the vehicle and/or the rotation of the boom so that the movement speed of the work apparatus does not exceed a predetermined base speed.

With this constitution, the travel speed of the chassis is limited to a predetermined travel speed range according to the position of the work platform, so a worker on the work platform can be prevented from being subjected to a large impact when the chassis travel comes to a stop, regardless of the amount of boom deployment, by setting this travel speed range so as to be narrower (that is, so that the maximum obtainable speed will be lower) the greater is the amount of deployment of the boom. At the same time, the load acting on the boom distal end is also smaller, so decreased strength of the chassis and boom can also be prevented.

In the present invention, the position detection means can comprise rotation angle detection means for detecting the angle of rotation of the boom, in which case the base speed is preset according to the angle of rotation of the boom, and when the vehicle travels on the basis of travel commands issued by the travel command means, the control means reads the base speed according to the angle of rotation of the boom detected by the rotation angle detection means, and controls the speed of the vehicle so that the movement speed of the work apparatus does not exceed the base speed that has been read.

With this constitution, since the travel speed of the chassis is limited to a predetermined travel speed range according to the angle of rotation of the boom, a worker on the work platform can be prevented from being subjected to a large impact when the chassis travel comes to a stop, just as above, by setting this travel speed range so as to be narrower the greater is the amount of deployment of the boom. The load acting on the boom distal end is also smaller, so decreased strength of the chassis and boom can also be prevented. Fewer detectors are required with this constitution, so the structure can be simplified.

The present invention may also be constituted such that the position detection means consists of side clearance detection means for detecting the clearance to the side of the work apparatus with respect to the vehicle, the base speed is preset according to the side clearance, and when the vehicle travels on the basis of travel commands issued by the travel command means, the control means reads the base speed according to the side clearance of the work apparatus detected by the side clearance detection means, and controls the speed of the vehicle so that the movement speed of the work apparatus does not exceed the base speed that has been read.

The present invention may also be constituted such that the position detection means consists of upward clearance detection means for detecting the clearance above the work apparatus with respect to the vehicle, the base speed is preset according to the upward clearance, and when the vehicle travels on the basis of travel commands issued by the travel command means, the control means reads the base speed according to the upward clearance of the work apparatus detected by the side clearance detection means, and controls the speed of the vehicle so that the movement speed of the work apparatus does not exceed the base speed that has been read.

The present invention can also be constituted such that, when a command for the rotational travel of the vehicle issued by the travel command means is outputted simultaneously with a command for rotationally operating the boom issued by the boom rotation command means, the control means voids the command issued by the boom rotation command means and uses only the command issued by the travel command means to control the vehicle so that it travels rotationally.

The present invention may also be constituted such that, when a command for the rotational travel of the vehicle issued by the travel command means is outputted simultaneously with a command for rotationally operating the boom issued by the boom rotation command means, and the rotational direction of the vehicle is the same as the rotational direction of the boom, the control means voids the command issued by the boom rotation command means and uses only the command issued by the travel command means to control the vehicle so that it travels rotationally.

The present invention may also be constituted such that, when a command for the rotational travel of the vehicle issued by the travel command means is outputted simultaneously with a command for rotationally operating the boom issued by the boom rotation command means, the control means controls the travel of the vehicle and the rotational of the boom so that the movement speed of the work apparatus does not exceed a predetermined base speed.

By controlling operation as above, the movement speed of the work apparatus will never exceed the predetermined base speed, not only when there is a command causing the chassis to rotate suddenly, but even when there is a command for the rotation of the boom simultaneously with a command for the rotational travel of the chassis in the same direction, so the chassis can be kept from toppling and a worker on the work apparatus (work platform) will not be subjected to a large impact (excessive momentum), allowing the work to be carried out more stably.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE PREFERRED EMBODIMENTS

Figure 1:
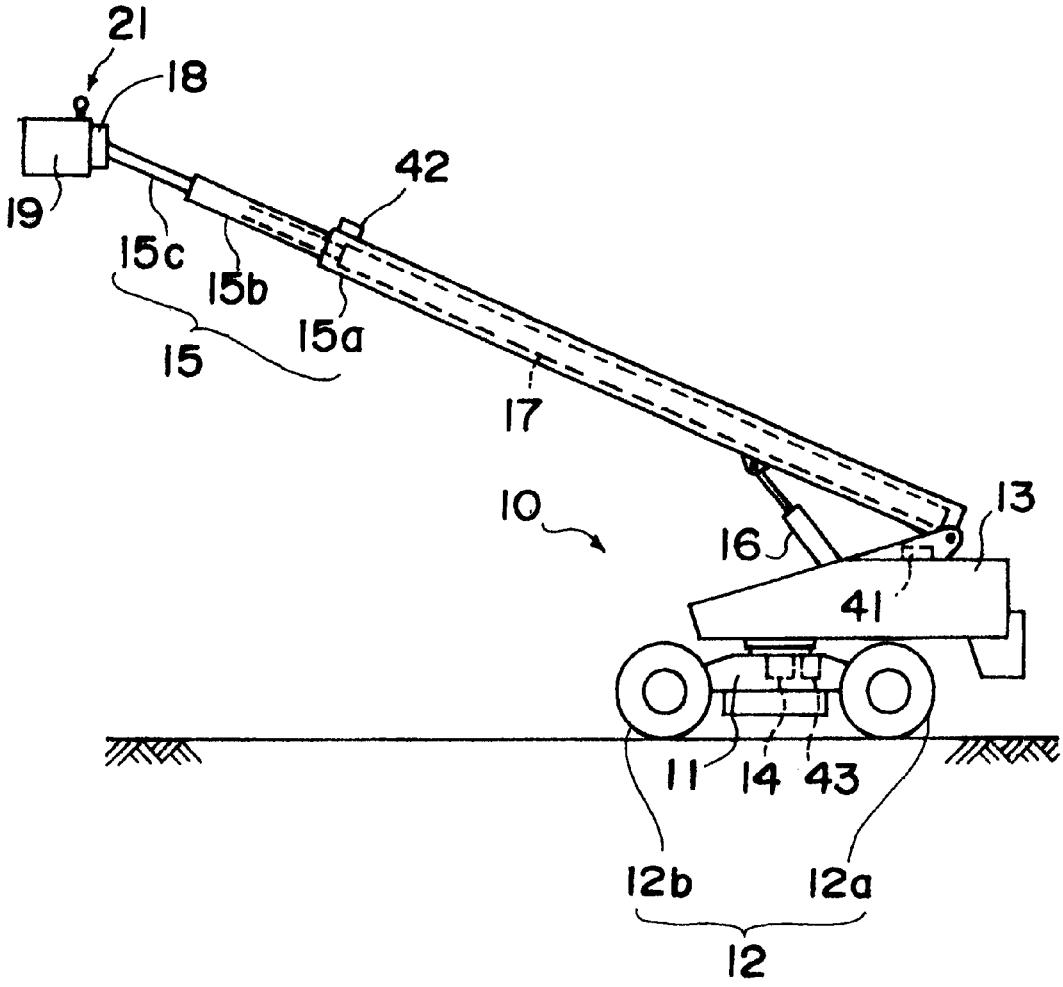
FIG. 1 is a side view of a wheel-type self-propelled lift equipped with the travel control device pertaining to the present invention.

FIG. 1 shows a self-propelled lift or boom lift (hereinafter referred to as lift) 10 equipped with the travel control device pertaining to the present invention. As shown in the figure, this lift 10 has travel wheels 12 (12*a* and 12*b*) at the four corners of a chassis 11, making it capable of travel, and also has a rotating platform 13 on top. This rotating platform 13 can be rotated horizontally with respect to the chassis 11 by a rotation motor 14 built into the chassis 11. The proximal end of a boom 15, comprising a proximal boom 15*a*, a middle boom 15*b*, and a distal boom 15*c* in telescoping fashion, pivots on the rotating platform 13, and the boom 15 can be raised and lowered by the operation of a hoisting cylinder 16 provided between the rotating platform 13 and the proximal boom 15*a*. An extension cylinder 17 is provided on the inside of the boom 15, and the operation of this extension cylinder 17 extends and retracts the boom 15.

A vertical post 18 is provided. to the distal end of the boom 15, and a work platform 19 on which a worker stands is attached to this vertical post 18. This work platform 19 can be oscillated (horizontally rotated) around the vertical post 18 by an oscillation motor (not shown) built into the work platform 19. The vertical post 18 is attached to the boom 15 via a leveling apparatus (not shown) so that it is always kept vertical, and therefore the work platform 19 can always be oscillated within the horizontal plane, regardless of the hoist angle of the boom 15.

Figure 2:
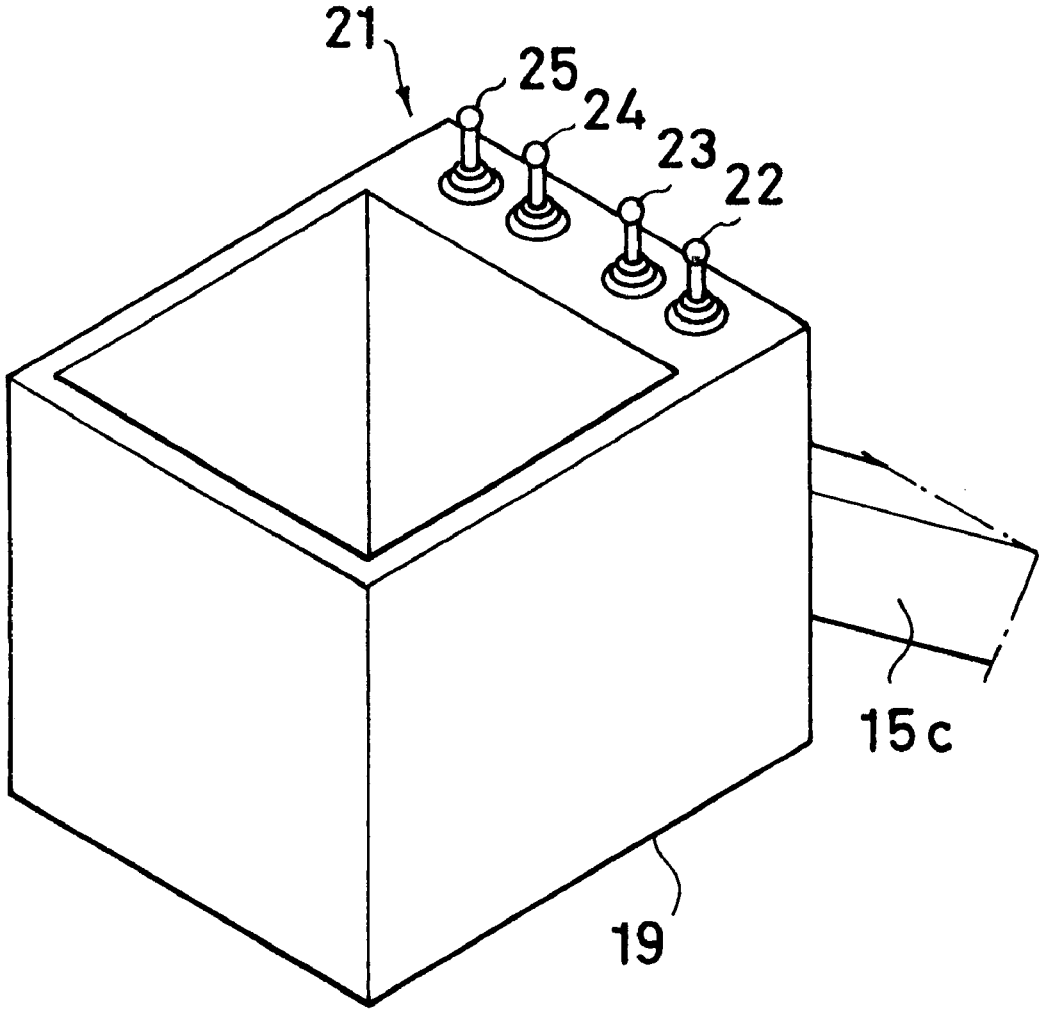
FIG. 2 is an oblique view of the work platform of the above-mentioned lift.

As shown in FIG. 2, a control box 21 is provided to the work platform 19, and this control box is provided with a boom control lever 22 and an oscillation control. lever 23. The boom control lever 22 is designed so that it can be manually tilted in any direction (360 degrees) from its middle position (its erect position), including forward, backward, left, right, and directions in between these, and so that it can be twisted around its axis. A potentiometer for detecting the amount of forward and backward tilt of the control lever 22, a potentiometer for detecting the amount of left and right tilt of the control lever 22, and a potentiometer for detecting the amount of twisting of the control lever 22 are provided to the proximal end of the boom control lever 22 (inside the control box 21), and the information detected by these various potentiometers is outputted as a hoisting cylinder drive signal, an extension cylinder drive signal, and a rotation motor drive signal, respectively. The oscillation control lever 23 is designed so that it can be tilted forward and backward from its middle position (erect position).

Figure 3:
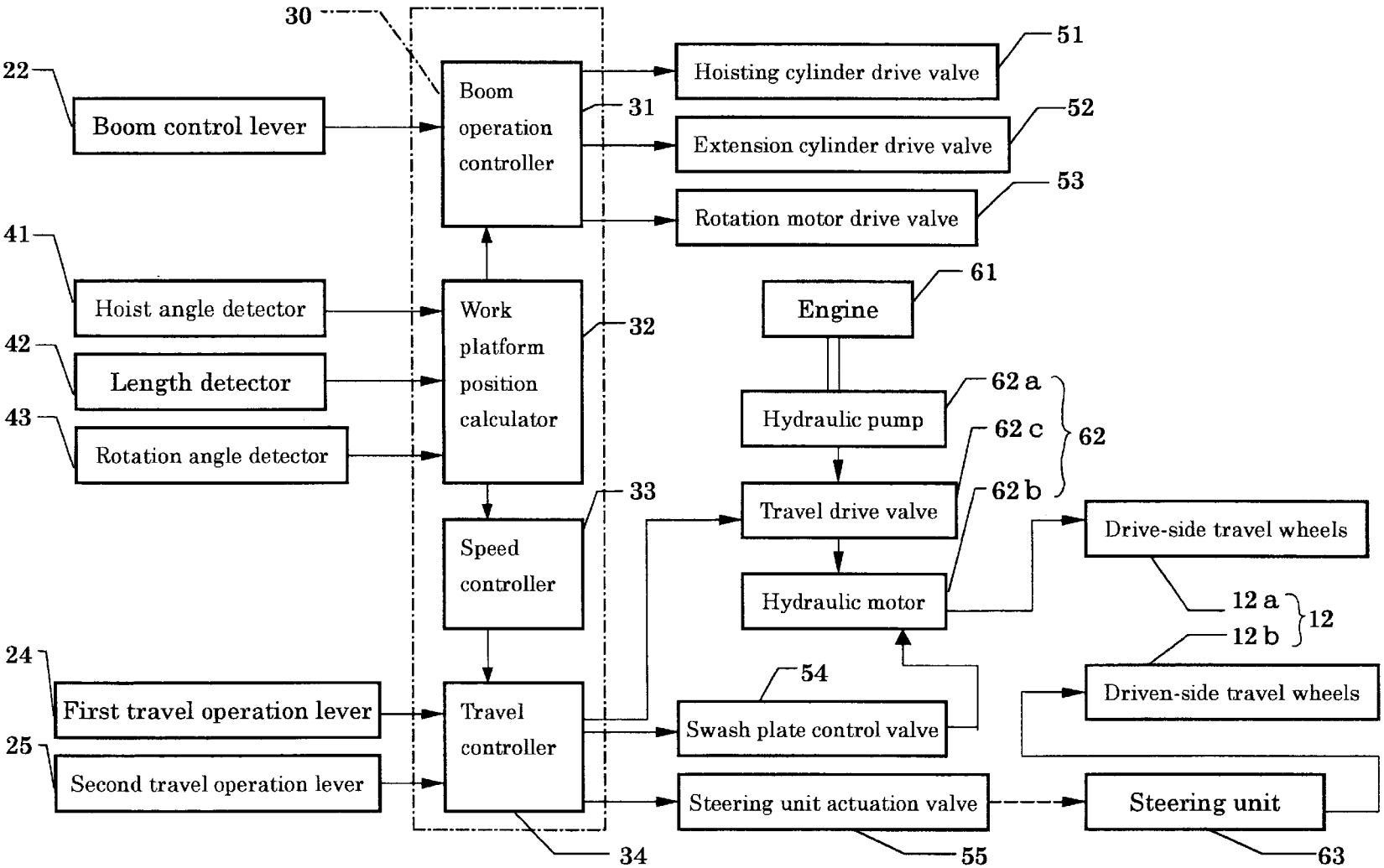
FIG. 3 is a block diagram illustrating the structure of the travel control device of the above-mentioned lift.

As shown in FIG. 3, a controller 30 has a boom operation controller 31, a work platform position calculator 32, a speed controller 33, and a travel controller 34. The above-mentioned hoisting cylinder drive signal, extension cylinder drive signal, and rotation motor drive signal are all inputted to the boom operation controller 31. Detection information from a hoist angle detector 41 that detects the hoist angle of the boom 15, a length detector 42 that detects the length of the boom 15, and a rotation angle detector 43 that detects the angle of rotation of the rotating platform 13 (that is, the angle of rotation of the boom 15) is inputted to the work platform position calculator 32, and the position of the work platform 19 with respect to the chassis 11 is constantly calculated. As shown in FIG. 1, the hoist angle detector 41 is provided in the vicinity of the proximal end of the proximal boom 15*a*, the length detector 42 to the distal end of the proximal boom 15*a*, and the rotation angle detector 43 in the vicinity of:the rotation motor 14.

The hoisting cylinder 16 is hydraulically driven by the operation of a hoisting cylinder drive valve 51, the extension cylinder 17 by the operation of an extension cylinder drive valve 52, and the rotation motor 14 by the operation of a rotation motor drive valve 53. These drive valves 51 to 53 are all operated through electromagnetic drive by the boom operation controller 31 of the controller 30 (see FIG. 3). The above-mentioned oscillation motor is designed such that the rotational direction and speed vary with the direction and amount of tilt of the oscillation control lever 23.

Thus, with the lift 10, the boom 15 can be raised or lowered, extended or retracted, and rotated with respect to the chassis 11 through operation of the boom control lever 22, and the work platform 19 can be oscillated around the vertical post 18 through operation of the oscillation control lever 23. The worker standing on the work platform 19 operates the levers himself, and is able to move the work platform 19 to the desired position and perform lift work while adjusting the orientation of the platform as desired.

As shown in FIG. 2, the control box 21 is also provided with a first travel operation lever 24 and a second travel operation lever 25. The first travel operation lever 24 can be tilted forward and backward from its middle position (its erect position), and can be put into a total of five positions, including neutral (middle position), forward first speed (for a small amount of forward operation), forward second speed (for a large amount of forward operation), reverse first speed (for a small amount of reverse operation), and reverse second speed (for a large amount of reverse operation). The above-mentioned position of the first travel operation lever 24 is detected by a potentiometer provided to the base of this control lever 24 (inside the control box 21), and is outputted as a position signal to the travel controller 34 of the controller 30 (see FIG. 4). The second travel operation lever 25 can be tilted to the left and right from its middle position (its erect position), and the direction and amount in which this second travel operation lever 25 is operated are detected by a potentiometer provided to the base of this control lever 25 (inside the control box 21), and outputted as an operation signal (including information about both the operation direction and the operation amount) to the travel controller 34 of the controller 30 (see FIG. 3).

A hydraulic transmission 62 is provided inside the chassis 11 and comprises a hydraulic pump 62*a* driven by an engine 61, and a hydraulic motor 62*b* that outputs a rotational force upon receiving the fluid discharged from this hydraulic pump 62*a* via a travel drive valve 62*c*. The wheels 12*a* used for travel on the drive side (the two rear wheels) are driven via this hydraulic transmission 62 (by the above-mentioned hydraulic motor 62*b*). The hydraulic motor 62*b* is a variable capacity type that makes use of a swash plate, and shifting between high and low speed can be performed by switching the angle of inclination of this swash plate. The swash plate of the hydraulic motor 62*b* is operated by hydraulic control from the swash plate control valve 54 that is electromagnetically driven by the travel controller 34. The amount and direction in which the fluid is supplied from the hydraulic pump 62*a* to the hydraulic motor 62*b* is adjusted by the travel drive valve 62*c*, allowing for speed regulation and switching between forward and reverse.

For example, the above-mentioned travel controller 34 actuates the swash plate control valve 54 and the travel drive valve 62*c* so that the output of the hydraulic transmission 62 will correspond to forward low speed when a forward first speed position signal has been inputted by operation of the first travel operation lever 24, and actuates the swash plate control valve 54 and the travel drive valve 62*c* so that the output of the hydraulic transmission 62 will correspond to forward high speed when a forward second speed position signal has been inputted. When a reverse first speed position signal is inputted, the swash plate control valve 54 and the travel drive valve 62*c* are actuated so that the output of the hydraulic transmission 62 will correspond to reverse low speed, and when a reverse second speed position signal is inputted, the swash plate control valve 54 and the travel drive valve 62*c* are actuated so that the output of the hydraulic transmission 62 will correspond to reverse high speed. When the position signal for neutral is inputted, the amount of fluid supplied to the hydraulic motor 62*b* is dropped to zero and the travel drive valve 62*c* is actuated so that the output of the hydraulic transmission 62 will correspond to neutral. When an operation signal has been inputted through operation of the second travel operation lever 25, the travel controller 34 electromagnetically drives a steering unit actuation valve 55 according to the information (operation direction and amount) contained in this signal, and hydraulically actuates a steering unit 63 so that the driven-side travel wheels 12*b* (the front to wheels) swing to the left or right with respect to the axle thereof (not shown).

Accordingly, a worker standing on the work platform 19 can drive the lift 10 by operating the levers, and can move forward within a low speed range (such as about 2 km/h or less) when the first travel operation lever 24 is in the forward first speed position, or move forward within a high speed range (such as about 4 km/h or less) when this lever is in the forward second speed position. Reverse travel within the above-mentioned low speed range is possible when the first travel operation lever 24 is put in the reverse first speed position, and reverse travel within the above-mentioned high speed range is possible when this lever is in the reverse second speed position. Steering control (to the left or right) during travel can be performed by operation of the second travel operation lever 25.

Here, the region in which the work platform 19 can be positioned by operation of the boom 15 is divided into a region D 1 in which the worker on the work platform 19 will not be subjected to a large impact if the chassis 11 stops during travel within the high speed range (a region in which the chassis 11 can travel within the high speed range) and a region D2 in which the worker on the work platform 19 will be subjected to a large impact if the chassis 11 stops during travel within the high speed range (a region in which the chassis 11 cannot travel within the high. speed range). The travel speed range of the chassis 11 corresponding to the position of the work platform 19 within region D1 is set at the above-mentioned high speed range, and the travel speed range of the chassis 11 corresponding to the position of the work platform 19 within region D2 is set at the above-mentioned low speed range. Accordingly, the speed controller 33 of the controller 30 puts restrictions on the travel controller 34 such that when it is calculated by the work platform position calculator 32 that the work platform 19 is within region D2, then even if a forward second speed or reverse second speed position signal has been inputted to the travel controller 34, the swash plate control valve 54 will not be moved to the forward high speed position or the reverse high speed position (the chassis 11 is prohibited from traveling in the high speed range). Specifically, the speed controller 33 controls the travel controller 34 such that the travel speed of the chassis 11 will be within the travel speed range set according to the position of the work platform 19.

Accordingly, when the amount of deployment of the boom 15 is small and the work platform 19 is located within region D1, then it is possible to select travel at a forward first speed (travel within the low speed range) or forward second speed (travel within the high speed range), but when the amount of deployment of the boom 15 is large and the work platform 19 is located within region D2, then travel is restricted to just the forward first speed (the same applies to reverse).

With a speed control device for a lift such as this, instead of having the travel speed of the chassis 11 set to a two-speed range as above, a speed limit corresponding to the position of the work platform 19 may be set ahead of time. For example, the travel speed range may be set so as to be narrower (that is, so that the maximum obtainable speed will be lower) the greater is the amount of deployment of the boom 15 (particularly the amount to the side). Here again, a worker on the work platform 19 can be prevented from being subjected to a large impact if the chassis 11 travel comes to a stop, regardless of the amount of boom 15 deployment. At the same time, the load acting on the distal end of the boom 15 is also smaller, so decreased strength of the chassis 11 and boom 15 can also be prevented.

Next, the lift speed control device pertaining to the second invention will be described. The structure of this speed control device is about the same as that of the lift speed control device pertaining to the first invention shown in FIG. 3, but is such that the amount of rotation of the boom 15 is the only factor in restricting the travel speed. This is because the flexural rigidity of the boom 15 in the lateral direction is less than that in the longitudinal direction, and the work platform 19 is attached to a vertical shaft (the vertical post 18) at the distal end of the boom 15, so the impact is greatest when the boom 15 is deployed to the side of the chassis 11. There is therefore no need for the hoist angle detector 41 or the length detector 42.

The rotational angle range that can be assumed by the boom 15 is divided into a rotational angle range D' in which the worker on the work platform 19 will not be subjected to a large impact if the chassis 11 stops during travel within the above-mentioned high speed range (a rotational angle range in which the chassis 11 can travel within the high speed range) and a rotational angle range D2' in which the worker on the work platform 19 will be subjected to a large impact if the chassis 11 stops during travel within the high speed range (a rotational angle range in which the chassis 11 cannot travel within the high speed range). In the setting of these ranges, it is preferable for the evaluation to be made while the boom 15 in as close to horizontal as possible and is fully extended. The travel speed range of the chassis 11 corresponding to the angle of rotation of the boom 15 within the rotational angle range D1' is set to the above-mentioned high speed range, and the travel speed range of the chassis 11 corresponding to the angle of rotation of the boom 15 within the rotational angle range D2' is set to the above-mentioned low speed range. Accordingly, the speed controller 33 of the controller 30 puts restrictions on the travel controller 34 such that when it is found that the angle of rotation of the boom 15 as detected by the rotation angle detector 43 is within region D2', then even if a forward second speed or reverse second speed position signal has been inputted to the travel controller 34, the swash plate control valve 54 will not be moved to the forward high speed position or the reverse high speed position (the chassis 11 is prohibited from traveling in the high speed range). Specifically, the speed controller 33 controls the travel controller 34 such that the travel speed of the chassis 11 will be within the travel speed range set according to the angle of rotation of the boom 15.

Figure 4:
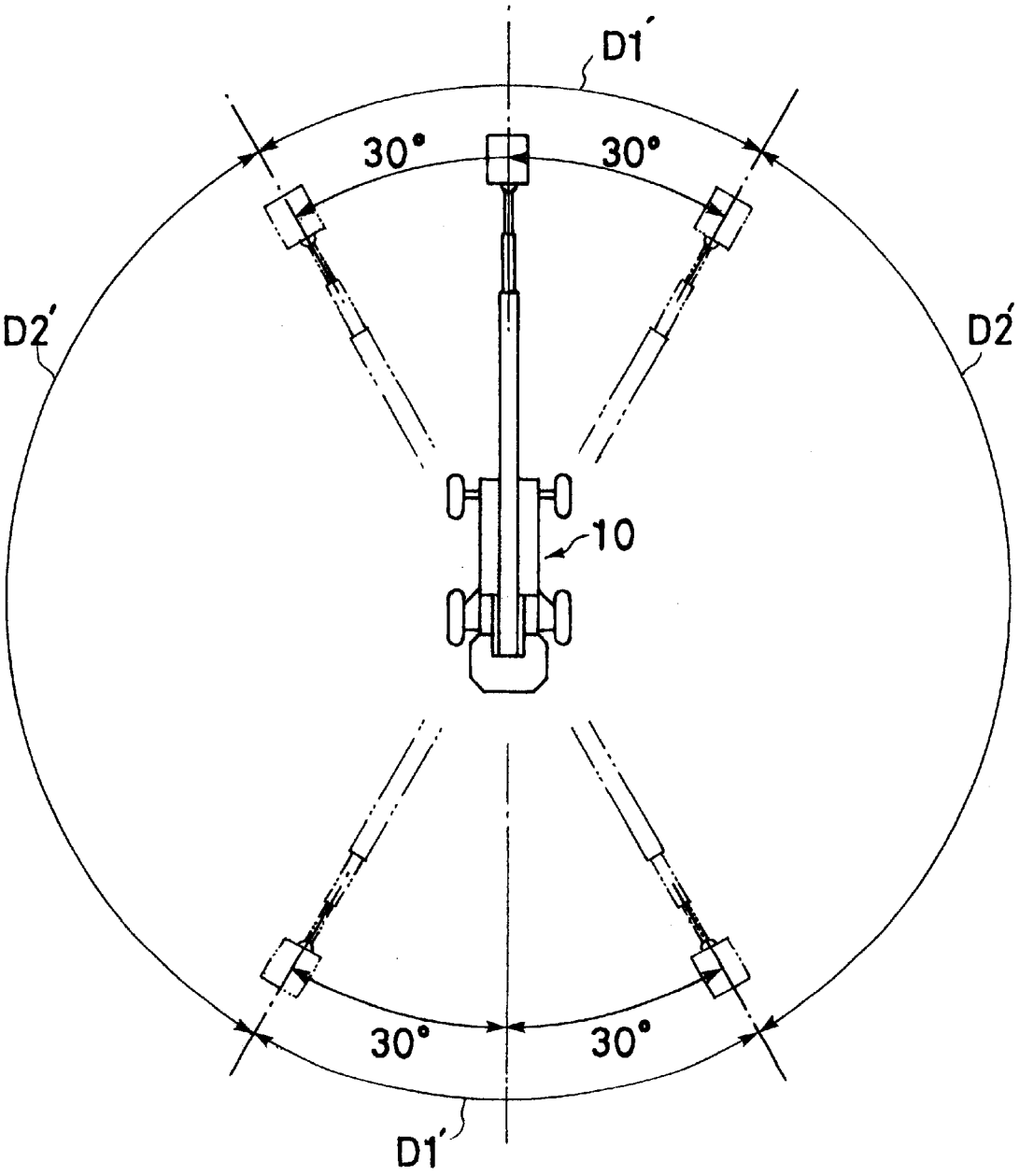
FIG. 4 is a plan view of a lift, and illustrates an example of the setting of the rotational angle range by the above-mentioned travel control device.

Accordingly, when the amount of rotation of the boom 15 to the side is small and the angle of rotation of the boom 15 is within the rotational angle range D1', then it is possible to select travel at a forward first speed (travel within the low speed range) or forward second speed (travel within the high speed range), but when the amount of rotation of the boom 15 to the side is large and the angle of rotation of the boom 15 is within region D2', then travel in the forward second speed is prevented, and travel is restricted to just the forward first speed (the same applies to reverse). FIG. 4 illustrates an example of setting the rotational angle ranges D1' and D2' when the rotational angle range D1' is no more than 30 degrees of side rotation of the boom 15.

With the lift speed control device pertaining to the second invention, instead of having the travel speed of the chassis 11 set to two levels as above, it may be set more narrowly according to the angle of rotation of the boom 15. For example, the travel speed range can be set to become narrower as the amount of rotation of the boom 15 to the side increases. In any case, the effect obtained with the lift speed control device pertaining to the second invention is the same as that with the lift speed control device pertaining to the first invention. Also, the structure of the lift speed control device pertaining to the second invention can be simpler because fewer detectors are required than with the lift speed control device pertaining to the first invention. The use of a limit switch in place of the rotation angle detector 43 is also possible since the step in which the position of the work platform 19 is calculated is omitted and the detected angle of rotation of the boom 15 can be used directly.

Up to this point the lift speed control devices pertaining to the first and second inventions have been described through examples, but the present invention is not limited to or by the above examples, and various design modifications are possible. For instance, in the above examples two types of travel speed range (low speed range and high speed range) could be selected with the first travel operation lever 24, so there were also two types of travel speed range (region D1 and D2, or rotational angle ranges D1' and D2'), but when three or more travel speed ranges can be selected (including continuous variation), then it is also possible for three or more travel speed ranges (including continuous variation) to be set according to the position of the work platform 19 or to the angle of rotation of the boom 15.

Furthermore, in the above examples, the travel controller 34 of the controller 30, the swash plate control valve 54, the hydraulic transmission 62, and so forth were provided as means for effecting the travel of the chassis 11, and the travel of the chassis 11 was controlled by controlling the operation of the swash plate control valve 54 and the travel drive valve 62*c* from the travel controller 34, but the travel of the chassis 11 does not. necessarily have to be controlled in this manner. For instance, the structure comprising the swash plate control valve 54 and the hydraulic transmission 62 may be replaced with an electric motor controlled by the travel controller 34, and the drive-side travel wheels 12*a* may be driven by this motor. Here again, the above-mentioned speed control can be accomplished by detecting the position of the work platform 19 or the angle of rotation of the boom 15 as in the above examples.

A self-propelled lift structured such that a worker standing on the work platform controlled the travel of the chassis was described in the above examples, but the present invention can also be applied to a lift of the type in which the travel of the chassis is controlled from a driver's seat on the chassis.

Figure 5:
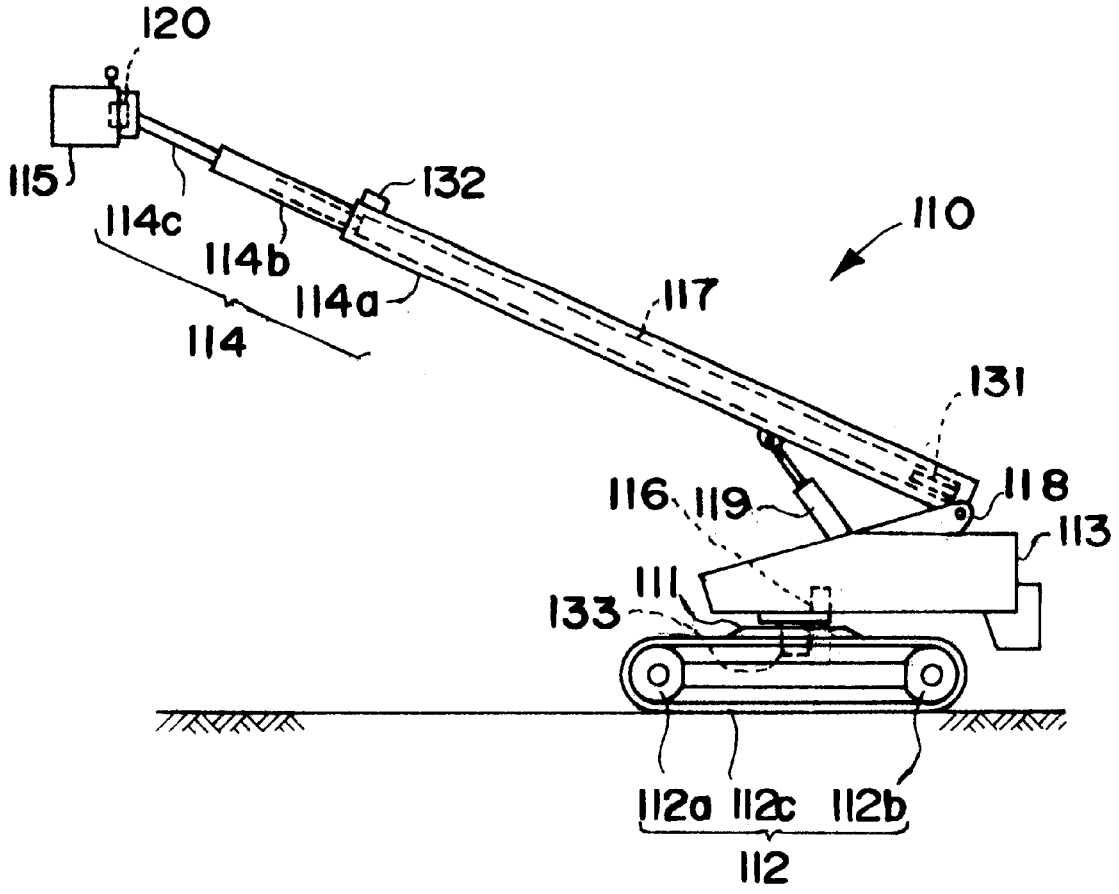
FIG. 5 is a side view of a crawler-type self-propelled lift equipped with the travel control device pertaining to the present invention.

Next, FIG. 5 illustrates a crawler-type lift (hereinafter referred to as lift) 110 equipped with the control device pertaining to the third invention. This lift 110 is structured such that a rotating platform 113 is rotatably provided to the top of a chassis 111 having a pair of left and right crawler units 112. An extensible boom 114 is hoistably attached to the top of this rotating platform 113. A work platform 115 on which a worker stands is horizontally rotatably attached to the distal end of the boom 114.

Each of the left and right crawler units 112 has a drive tumbler 112*a* rotationally driven through the supply of hydraulic fluid from a hydraulic pump P driven by an engine E (the engine E and the hydraulic pump P are not shown in FIG. 5), an idler wheel 112*b* able to rotate freely, and a crawler track 112*c* that encircles these wheels 112*a* and 112*b*.

The rotating platform 113 is designed so that it can be rotated horizontally with respect to the chassis 111 by the hydraulic drive of a rotation motor 116. The boom 114 comprises a proximal boom 114*a*, a middle boom 114*b*, and a distal boom 114*c* in telescoping fashion, and is designed so that it can be extended and retracted by the hydraulic drive of an extension cylinder 117 built into the boom 114. The boom 114 is attached to the rotating platform 113 such that the proximal boom 114*a* pivots on a boom support member 118 formed at the top of the rotating platform 113, and the boom 114 can be raised and lowered with respect to the chassis 111 by the hydraulic drive of a hoisting cylinder 119 provided between the rotating platform 113 and the proximal boom 114*a*. The hoisting cylinder 119, the extension cylinder 117, and the rotation motor 116, just like the above-mentioned drive tumblers 112*a* of the crawler units 112, are operated by the pressure of hydraulic fluid supplied from the hydraulic pump P built into the rotating platform 113.

A vertical post (not shown) structured such that it is always kept vertical is attached to the distal end of the boom 114, and a work platform 115 is attached to this vertical post. Therefore, the work platform 115 can always be kept horizontal, regardless of the attitude of the boom 114. Also, the work platform 115 can be oscillated horizontally with respect to the vertical post by driving an electric oscillation motor 120 provided on the inside of the work platform 115.

Figure 6:
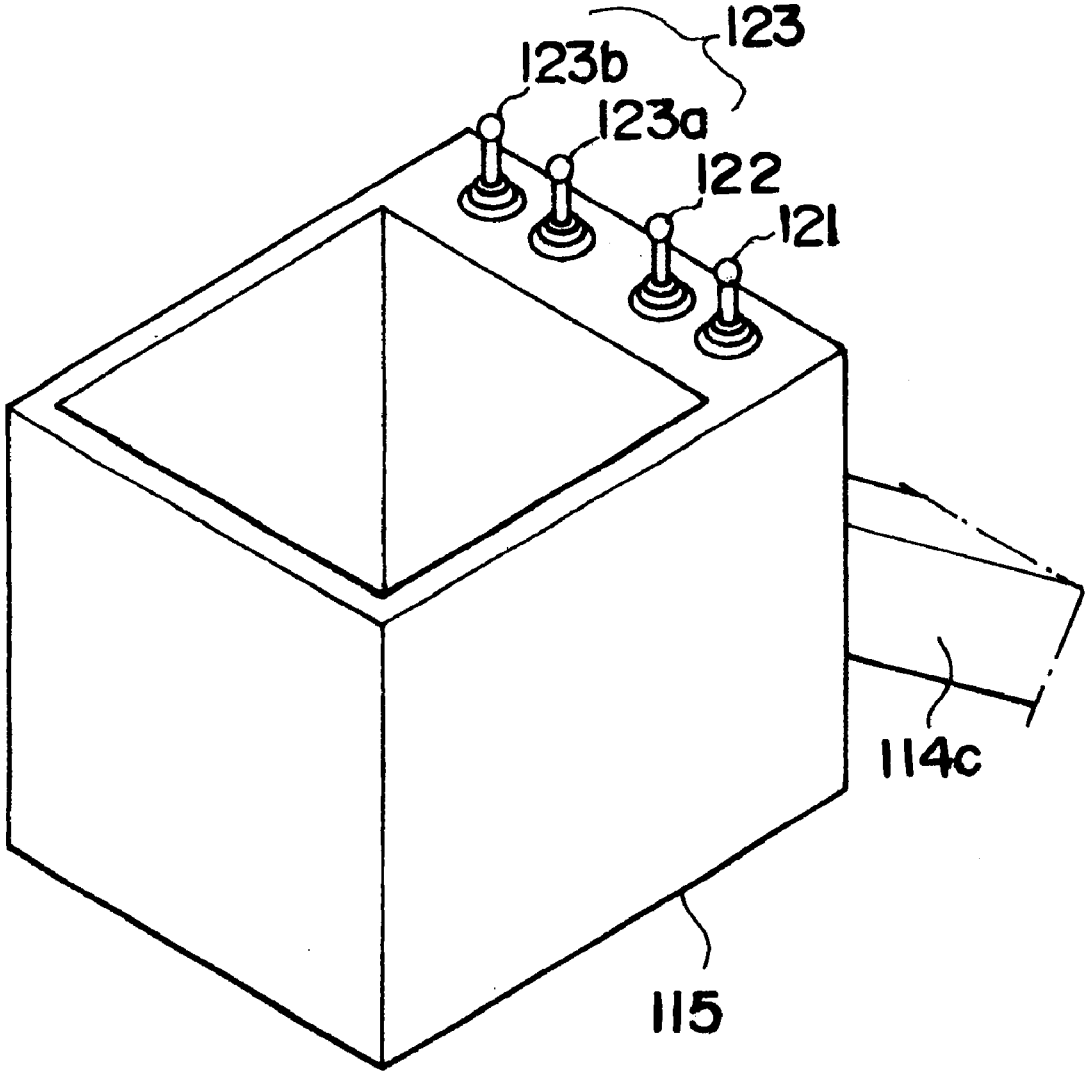
FIG. 6 is an oblique view of the work platform of the above-mentioned crawler-type self-propelled lift.

As shown in FIG. 6, the work platform 115 is provided with a boom operation lever 121, an oscillation operation lever 122, and a crawler unit operation lever 123. The crawler unit operation lever 123 comprises levers 123*a* and 123*b* corresponding to the left and right crawler units 112. The boom operation lever 121 can be tilted in any direction (360 degrees) from its middle position, including forward, backward, left, and right, and can be twisted around its axis. The oscillation operation lever 122 and the crawler unit operation levers 123*a* and 123*b* are all designed so that they can be tilted forward or backward from their middle position. These levers are all operated manually, but are designed so that they automatically return to their middle position when released from their tilted or twisted state.

A potentiometer for detecting the amount of forward and backward tilt (the tilt direction and amount), a potentiometer for detecting the amount of left and right tilt (the tilt direction and amount), and a potentiometer for detecting the twist state (the twist direction and amount) of the boom operation lever 121 are provided at the base of this lever 121. The information detected by these various potentiometers is outputted as a command signal for driving the hoisting cylinder 119, a command signal for driving the extension cylinder 117, and a command signal for driving the rotation motor 116, respectively.

The oscillation operation lever 122 serves as an on/off switch for the oscillation motor 120, which is turned on when the lever 122 is in its middle position, and off when the lever 122 is tilted forward or backward. Furthermore, when the oscillation operation lever 122 is tilted forward, the oscillation motor 120 rotates in the forward direction and the work platform 115 turns left around the vertical post, but when the oscillation operation lever 122 is tilted backward, the oscillation motor 120 rotates in the reverse direction and the work platform 115 turns right around the vertical post.

Potentiometers for detecting the forward and backward tilt (the tilt direction and amount) of the left and right crawler unit operation levers 123*a* and 123*b* are provided at the bases of these levers. The information detected by these potentiometers is outputted as command signals for driving the left and right crawler units 112.

A hoist angle detector 131 and a length detector 132 are provided to the proximal end and distal end, respectively, of the proximal boom 114*a*. The hoist angle and length of the boom 114 are detected by these detectors 131 and 132. Also, a rotation angle detector 133 is provided in the vicinity of the rotation motor 116, and detects the angle of rotation of the rotating platform 113, that is, the angle of rotation of the boom 114.

Figure 7:
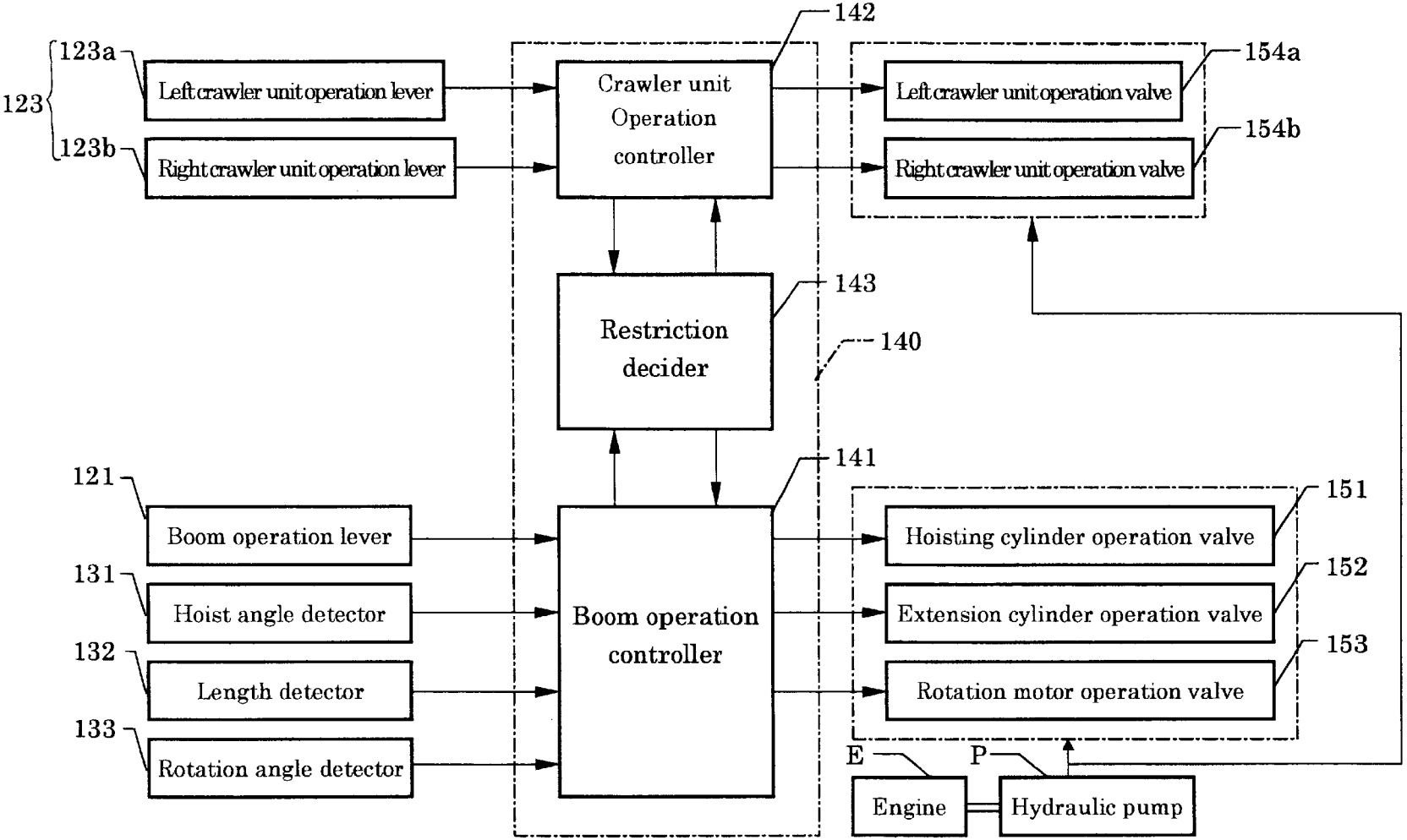
FIG. 7 is a block diagram illustrating the structure of the travel control device of the above-mentioned crawler-type self-propelled lift.

FIG. 7 is a block diagram of the structure of a control system including the control device pertaining to the present invention. As shown in this figure, a controller 140 has a boom operation controller 141, a crawler unit operation controller 142, and a restriction decider 143. The command signals outputted by the operation of the boom operation lever 121 are inputted to the boom operation controller 141, and the command signals outputted by the operation of the left and right crawler unit operation levers 123*a* and 123*b* are inputted to the crawler unit operation controller 142. The detection information signals from the hoist angle detector 131, the length detector 132, and the rotation angle detector 133 are all inputted to the boom operation controller 141. The boom operation controller 141 and the crawler unit operation controller 142 are each designed so as to be able to exchange information with the restriction decider 143.

A hoisting cylinder operation valve 151, an extension cylinder operation valve 152, and a rotation motor operation valve 153, which control the supply of hydraulic fluid to the hoisting cylinder 119, the extension cylinder 117, and the rotation motor 116 for the operation of these components, undergo electromagnetic proportional drive on the basis of command signals from the boom operation controller 141. Left and right crawler unit operation valves 154*a* and 154*b*, which control the supply of hydraulic fluid to the left and right crawler units 112 for the operation of these units, undergo electromagnetic proportional drive on the basis of command signals from the crawler unit operation controller 142.

With the crawler-type boom lift 110 structured as above, when a worker standing on the work platform 115 tilts or twists the boom operation lever 121, a command signal corresponding to this operation is inputted to the boom operation controller 141 of the controller 140. The boom operation controller 141 subjects the various operation valves 151 to 153 to electromagnetic proportional drive according to the information about the operation direction (tilt or twist direction) and operation amount (tilt or twist amount) of the boom operation lever 121 included in the inputted command signal. As a result, the boom 114 is raised or lowered, extended or retracted, or rotated according to the operation of the boom operation lever 121.

Thus, with the lift 110, the boom 114 can be raised or lowered, extended or retracted, and rotated through operation of the boom operation lever 121, and the work platform 115 can be oscillated around the vertical post through operation of the oscillation operation lever 122 as discussed above, so a worker standing on the work platform 115 is able to move the work platform 115 to the desired position by his own lever operation, and to perform lift work while adjusting the orientation of the platform as desired.

Also, when a worker standing on the work platform 115 tilts the left and right crawler unit operation levers 123*a* and 123*b*, command signals corresponding to this operation are inputted to the crawler unit operation controller 142 of the controller 140. The crawler unit operation controller 142 subjects the left and right crawler unit operation valves 154*a* and 154*b* to electromagnetic proportional drive according to the information about the operation direction (tilt direction) and operation amount (tilt amount) of the left and right crawler unit operation levers 123*a* and 123*b* included in the inputted command signals. As a result, the left and right crawler units 112 rotate forward or backward according to the operation of the crawler unit operation levers 123*a* and 123*b*. It is possible to control the travel speed of the chassis 111 by operating the crawler unit operation levers 123*a* and 123*b* so as to adjust the drive amount of the crawler unit operation valves 154*a* and 154*b*, but this control can also be accomplished by controlling the speed of the engine E so as to adjust the amount of operating fluid discharged from the hydraulic pump P. The engine is also quieter in this case. The travel speed of the chassis 111 can be controlled by adjusting the amount of operating fluid discharged even when the hydraulic pump P is a variable capacity type.

The left and right crawler units 112 are designed so that they can be operated independently and either forward or backward as desired. The chassis 111 can be moved forward or backward by operating both units in the same direction at the same time. The chassis 111 can be turned by operating just the left or the right unit, or by operating them in opposite directions. The former case is a turn in which the crawler unit 112 on the side not being operated serves as a pivot point (pivot turn), whereas the latter is a turn in the same spot (spin turn).

In the boom operation controller 141, the position of the work platform 115 with respect to the chassis 111 is continually being calculated on the basis of the detection results from the hoist angle detector 131, the length detector 132, and the rotation angle detector 133, and this information is sent to the restriction decider 143. The command signals from the left and right crawler unit operation levers 123*a* and 123*b* are sent from the crawler unit operation controller 142 to the restriction decider 143, and when notified that the command signals from these crawler unit operation levers 123*a* and 123*b* are to turn the chassis 111, the restriction decider 143 calculates the torque at which to turn the chassis 111 corresponding to these command signals, and the overall weight distribution of the lift 110 using the calculated position of the work platform 115 and the loaded weight of the work platform 115 (may be fixed at the maximum, but a load detector may instead by provided and used to detect the actual weight).

Next, the restriction decider 143 calculates from the above-mentioned torque and overall weight distribution of the lift 110 the turning speed (angle speed) of the chassis 111 that will probably occur when the chassis 111 is turned on the basis of the above-mentioned command signals, and from the relation between this turning speed and the above-mentioned position of the work platform 115 with respect to the chassis 111 (specifically, the horizontal distance from the rotational axis of the rotating platform 113 to the work platform 115), calculates the movement speed of the work platform 115 (the movement speed within the horizontal plane resulting from turning) that will probably occur when this turn is executed. The movement speed of the work platform 115 thus calculated is compared with a predetermined base speed, and if it is decided that the movement speed of the work platform 115 exceeds this base speed, a restriction signal is outputted to the crawler unit operation controller 142.

The crawler unit operation controller 142, as mentioned above, operates the left and right crawler units 112 on the basis of the command signals outputted from the crawler unit operation levers 123*a* and 123*b* (operates the left and right crawler unit operation valves 154*a* and 154*b*), but when a restriction signal has been outputted from the restriction decider 143, the turning of the chassis 111 is decelerated so that the movement speed of the work platform 115 will not exceed the above-mentioned base speed (the turn is restricted). Accordingly, the movement speed of the work platform 115 will never exceed the base speed, even when an operation that would suddenly turn the chassis 111 is performed by the crawler unit operation levers 123*a* and 123*b*.

The command signals from the boom operation lever 121 are sent from the boom operation controller 141 to the restriction decider 143, and the restriction decider 143 outputs a restriction signal to the boom operation controller 141 when it finds that a command signal to turn the chassis 111 has been issued from the crawler unit operation levers 123*a* and 123*b* simultaneously with a command signal to turn the boom 114 issued from the boom operation lever 121.

Upon receiving this restriction signal, the boom operation controller 141 does not perform any turning operation of the boom 114, ignoring any command signals that may have been outputted from the boom operation lever 121, and just the crawler unit operation controller 142 operates the crawler units 112 on the basis of the command signals from the crawler unit operation levers 123*a* and 123*b*, and turns the chassis 111. Here again, any turning of the chassis 111 in which the movement speed of the work platform 115 would exceed the base speed is restricted as mentioned above. Therefore, the movement speed of the work platform 115 will never exceed the base speed even if a turn command is issued for the boom 114 simultaneously with a turn command for the chassis 111 in the same direction. Here again, any turning of the chassis 111 in which the movement speed of the work platform 115 would exceed the base speed is, of course, restricted as mentioned above.

Thus, the movement speed of the work platform 115 will never exceed the predetermined base speed, even when the crawler unit operation levers 123*a* and 123*b* are operated so that the chassis 111 is turned suddenly, or when a command to turn the chassis 111 is issued simultaneously with a command to turn the boom 114 in the same direction, so the chassis 111 can be prevented from toppling, and a worker on the work platform 115 can be prevented from being subjected to a large impact (excessive momentum), allowing the work to be carried out more safely. The above-mentioned base speed is set to a level at which there will be no danger of the chassis 111 toppling due to its momentum (centrifugal force), and a worker on the work platform 115 will not be subjected to a large shock if the turn is stopped (eg, about 0.4 to 0.5 m/sec if the length of the boom 114 is about 10 m), when the boom 114 is rotated or when the work platform 115 is at its maximum loaded weight.

The control device pertaining to the fourth invention will now be described. With the control device pertaining to the fourth invention, the only difference from the processing carried out by the restriction decider 143 of the controller 140 in the above-mentioned control device pertaining to the third invention is the processing when a command to turn the chassis 111 is issued from the left and right crawler unit operation levers 123*a* and 123*b* simultaneously with a command to turn the boom 114 issued from the boom operation lever 121. Specifically, the restriction decider 143 outputs a restriction signal to the boom operation controller 141 when it finds that a command to turn the chassis 111 is issued from the left and right crawler unit operation levers 123*a* and 123*b* simultaneously with a command to turn the boom 114 issued from the boom operation lever 121, and that the directions of these two turns are the same.

Upon receiving this restriction signal, the boom operation controller 141 does not perform any turning operation of the boom 114, ignoring any command signals that may have been outputted from the boom operation lever 121, and just the crawler unit operation controller 142 operates the crawler units 112 on the basis of the command signals from the crawler unit operation levers 123*a* and 123*b*, and turns the chassis 111. Here again, any turning of the chassis 111 in which the movement speed of the work platform 115 would exceed the base speed is restricted as mentioned above. Therefore, the movement speed of the work platform 115 will never exceed the predetermined base speed with this structure, either, and the same effect can be obtained as with the control device pertaining to the third invention.

The control device pertaining to the fifth invention is the same as the control device pertaining to the fourth invention in that the only difference from the processing carried out by the restriction decider 143 of the controller 140 in the control device pertaining to the third invention is the processing when a command to turn the chassis 111 is issued from the left and right crawler unit operation levers 123*a* and 123*b* simultaneously with a command to turn the boom 114 issued from the boom operation lever 121. Specifically, with the control device pertaining to the fifth invention, the restriction decider 143 outputs a restriction signal to the crawler unit operation controller 142 and the boom operation controller 141 when it finds that a command to turn the chassis 111 is issued from the left and right crawler unit operation levers 123*a* and 123*b* simultaneously with a command to turn the boom 114 issued from the boom operation lever 121, and that the directions of these two turns are the same.

Upon receiving this restriction signal, the crawler unit operation controller 142 and the boom operation controller 141 decelerate both the rotation of the boom 114 and the turning of the chassis 111 so that the sum of the movement speed component of the work platform 115 produced by the turning of the chassis 111 and the movement speed component of the work platform 115 produced by the rotation of the boom 114 does not exceed the above-mentioned base speed. Again with this structure, the movement speed of the work platform 115 never exceeds the predetermined base speed, and the same effect can be obtained as with the control devices pertaining to the third and fourth inventions.

Embodiments of the control device pertaining to the present invention were described above, but the present invention is not limited to the above structures, and various modifications are possible. For example, in the above embodiments, a self-propelled, crawler-type boom lift was used as an example, but this may instead be a lift structured such that a driver's seat may be provided to the chassis and the chassis is driven from this driver's seat. Also, the work apparatus at the distal end of the boom 114 may be a crane apparatus (sheave) or the like instead of the work platform 115, in which case the same effect can be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 10-373113 filed on Dec. 28, 1998, and No. 11-048966 filed on Feb. 25, 1999, which are incorporated herein by reference.

What is claimed is:

1. In a boom lift vehicle comprising a vehicle equipped with a travel apparatus and capable of travel, a boom that is attached to said vehicle and is at least vertically tiltable and horizontally rotatable, and a work platform attached to the distal end of said boom; a travel and rotation control device for controlling the travel of said vehicle and/or the rotation of said boom, said control device comprising:

travel command means for outputting commands for the travel of said vehicle:

boom rotation command means for outputting commands for rotationally operating said boom;

position detection means for detecting the position of said work platform with respect to said vehicle;

control means for calculating the movement speed of said work platform at a position detected by said position detection means according to a travel command issued by at least one of said travel command means and a boom rotation command issued by said boom rotation command means, and controlling the travel of said vehicle and/or the rotation of said boom so that the movement speed of said work apparatus does not exceed a predetermine base speed;

traveling speed calculation means for calculating the traveling speed of said vehicle according to a travel command issued by said travel command means;

moving speed calculation means for calculating the moving speed of said platform relative to said vehicle according to a boom rotation command issued by said boom rotation command means;

resultant moving speed calculation means for calculating the resultant moving speed of said platform at a position detected by said position detection means based on the traveling speed of said vehicle and the moving speed of said platform; and control means for controlling the travel of said vehicle and or the rotation of said boom so that the resultant moving speed does not exceed a predetermined base speed.

2. The travel and rotation control device for a boom lift vehicle according to claim 1, wherein said position detection means comprises rotation angle detection means for detecting the angle of rotation of said boom, said base speed is preset according to the angle of rotation of said boom, and when said vehicle is made to travel on the basis of travel commands issued by said travel command means, said control means reads said base speed according to the angle of rotation of said boom detected by said rotation angle detection means, and controls the speed of said vehicle so that the movement speed of said work platform does not exceed the base speed that has been read.

3. The travel and rotation control device for a boom lift vehicle according to claim 1, wherein said position detection means comprises side clearance detection means for detecting the clearance to the side of said work platform with respect to said vehicle, said base speed is preset according to said side clearance, and when said vehicle is made to travel on the basis of travel commands issued by said travel command means, said control means reads said base speed according to the side clearance of said work apparatus detected by said side clearance detection means, and controls the speed of said vehicle so that the movement speed of said work platform does not exceed the base speed that has been read.

4. The travel and rotation control device for a boom lift vehicle according to claim 1, wherein said position detection means consists of upward clearance detection means for detecting the clearance above said work platform with respect to said vehicle, said base speed is preset according to said upward clearance, and when said vehicle is made to travel on the basis of travel commands issued by said travel command means, said control means reads said base speed according to the upward clearance of said work platform detected by said side clearance detection means, and controls the speed of said vehicle so that the movement speed of said work platform does not exceed the base speed that has been read.

5. The travel and rotation control device for a boom lift vehicle according to claim 1, wherein, when a command for the turning travel of said vehicle issued by said travel command means is outputted simultaneously with a command means, said control means voids the command issued by said travel command means to control said vehicle so that it makes a turn.

6. The travel and rotation control device for a boom lift vehicle according to claim 1, wherein, when a command for the turning travel of said vehicle issued by said travel command means is outputted simultaneously with a command for rotationally operating said boom issued by said boom rotation command means, and the turning direction of said vehicle is the same as the rotational direction of said boom, said control means voids the command issued by said boom rotation command means and uses only the command issued by said travel command means to control said vehicle so that it makes a turn.

7. The travel and rotation control device for a boom lift vehicle according to claim 1, wherein, when a command for the turning travel of said vehicle issued by said travel command means is outputted simultaneously with a command for rotationally operating said boom issued by said boom rotation command means, said control means controls the travel of said vehicle and the rotational of said boom so that the movement speed of said work platform does not exceed a predetermined base speed.

8. The travel and rotation control device for a boom lift vehicle according to any one of claims 1 to 7, wherein said travel apparatus consists of wheels and a drive apparatus for driving these wheels.

9. The travel and rotation control device for a boom lift vehicle according to any one of claims 1 to 7, wherein said travel apparatus comprises a pair of left and right crawlers and a drive apparatus for driving these crawlers.

10. The travel and rotation control device for a boom lift according to any one of claims 1 to 7, wherein said travel command means and said boom rotation command means are provided to said work platform.

11. The travel and rotation control device for a boom lift vehicle according to any one of claims 1 to 7, wherein said travel command means and said boom rotation command means are provided to said vehicle.

* * * * *